US005544593A

United States Patent [19]

Canfield et al.

[11] Patent Number: 5,544,593

[45] Date of Patent: Aug. 13, 1996

[54] ADJUSTABLE DESK SYSTEM

[75] Inventors: Thomas F. Canfield, Hopkins; Lloyd C. Mollenkopf, Apple Valley; Russell J. Rein, St. Louis Park; Larry M. Jilk, Farmington, all of Minn.

[73] Assignee: Rosemount Office Systems, Inc., Lakeville, Minn.

[21] Appl. No.: 117,257

[22] Filed: Sep. 3, 1993

[51] Int. Cl.[6] ..... A47B 35/00

[52] U.S. Cl. ..... 108/50; 312/196; 108/110; 108/182

[58] Field of Search ..... 108/110, 50, 182, 108/153, 108; 312/223.3, 194, 196

[56] References Cited

U.S. PATENT DOCUMENTS

| | | |
|---|---|---|
| 2,841,452 | 7/1958 | Borgman et al. . |
| 3,592,289 | 9/1968 | Aysta et al. . |
| 3,762,116 | 10/1973 | Anderson et al. . |
| 3,877,191 | 4/1975 | Munsey et al. . |
| 4,163,537 | 7/1977 | Mourgue . |
| 4,334,374 | 3/1981 | Spamer et al. . |
| 4,832,152 | 5/1989 | Schuelke et al. . |
| 4,914,873 | 4/1990 | Newhouse . |
| 4,962,805 | 10/1990 | Allen . |
| 5,038,539 | 8/1991 | Kelley et al. . |
| 5,083,512 | 1/1992 | Newhouse et al. . |

OTHER PUBLICATIONS

The Unicell Flexible Laboratory Furniture System brochure; publication date—1989.

Allsteel—Syntrax II brochure; publication date—unknown (admitted prior art).

Lear Siegler Inc., Burroughs Division, Sigma 200 brochure; publication date—1984.

System One Cube Desks brochure, Haskell of Pittsburgh, Inc.; publication date—unknown (admitted prior art).

Atlantic Furniture Systems brochure; publication date—unknown (admitted prior art).

Marvel Advanced Office Furniture brochure; publication date—1989.

Hayworth, Inc. brochure—RACE System; publication date—1990.

LA.Z.BOY Revisions brochure—publication date—unknown (admitted prior art).

Krueger WorkZone brochure—publication date—unknown (admitted prior art).

Steelcase Context brochure—publication date—1989.

LEGS by SMED brochure—publication date—unknown (admitted Prior art).

Arlink Parts & Information Series 8000 brochure, including assembly instructions, publication date is more than one year prior to Sep. 3, 1993, pp. 1–32.

*Primary Examiner*—José V. Chen

*Attorney, Agent, or Firm*—Westman, Champlin & Kelly, P.A.

[57] ABSTRACT

A desk top system which has a basic superstructure upright that permits attaching cantilevered supports for supporting desk tops, pedestals, and the like so that they can be adjusted easily and conveniently relative to one another. The pedestals can be removed if the pedestals interfere with the movement of the feet of a user when the desk tops are supported adequately in other manners. The superstructures permit back to back mounting of cabinets, desk tops and the like. The units thus have great versatility and adjustability for providing desk space for users.

29 Claims, 11 Drawing Sheets

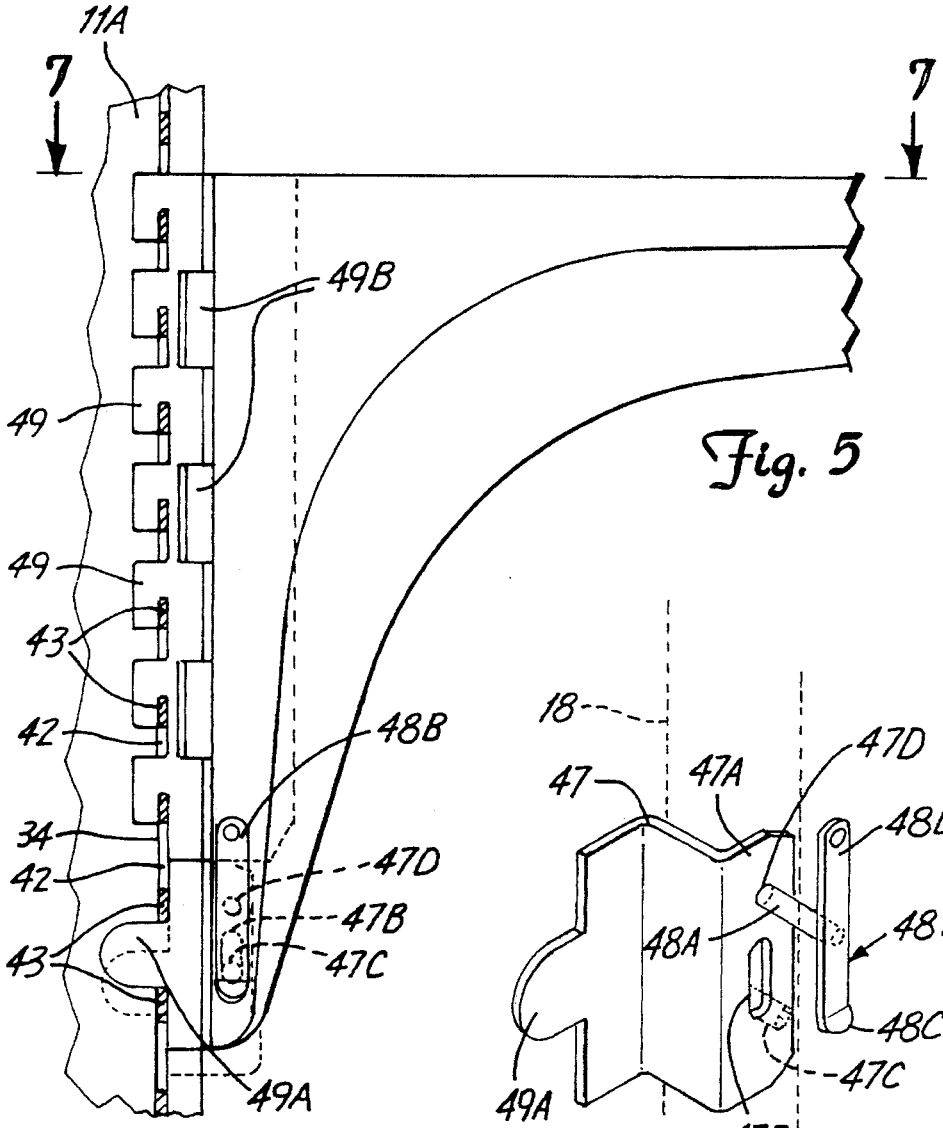
Fig. 5
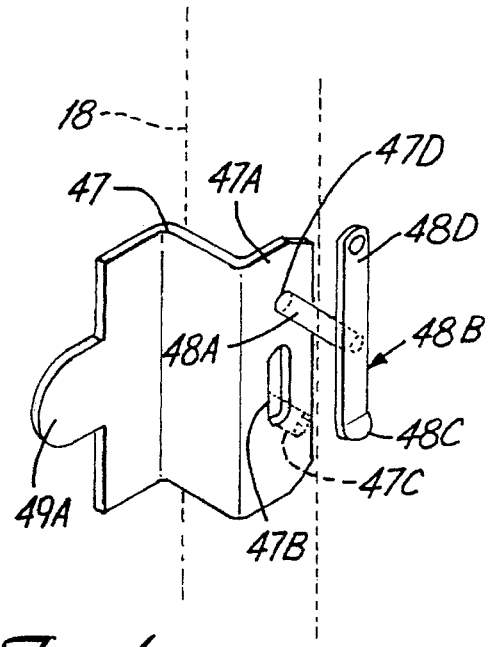
Fig. 6
Fig. 7
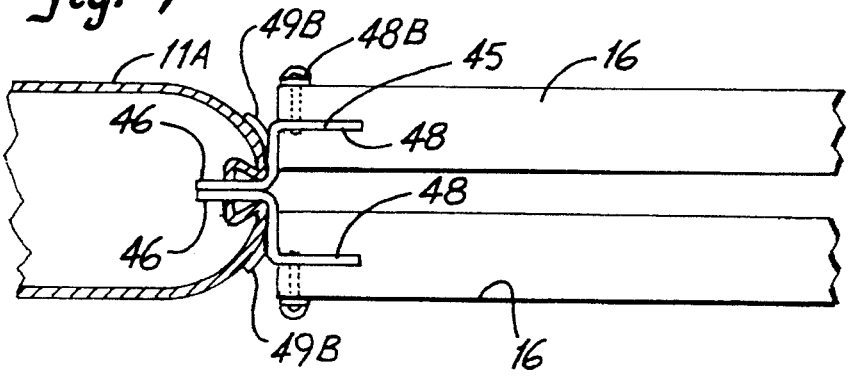

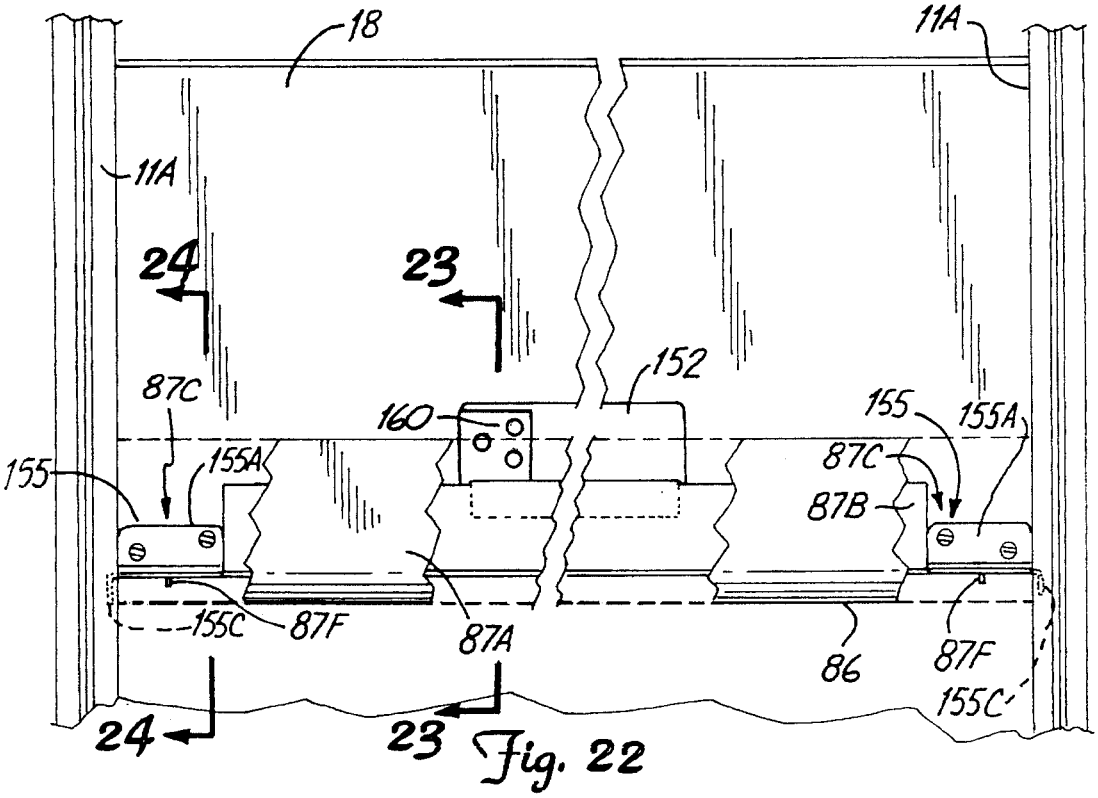
Fig. 22
Fig. 23
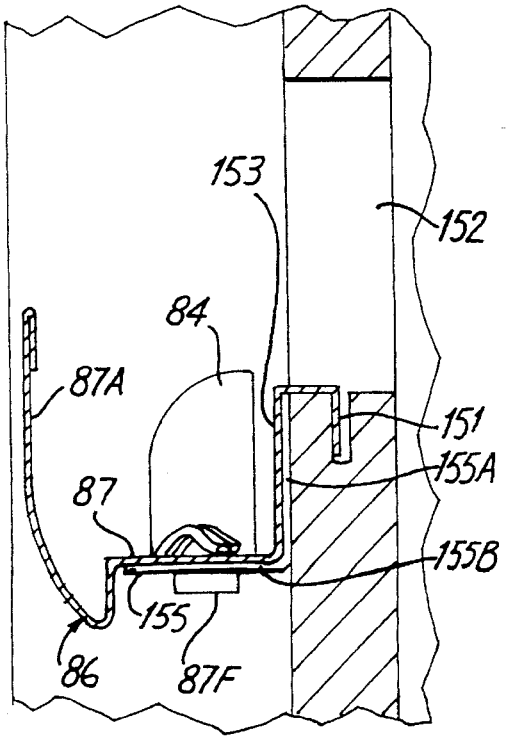
Fig. 24
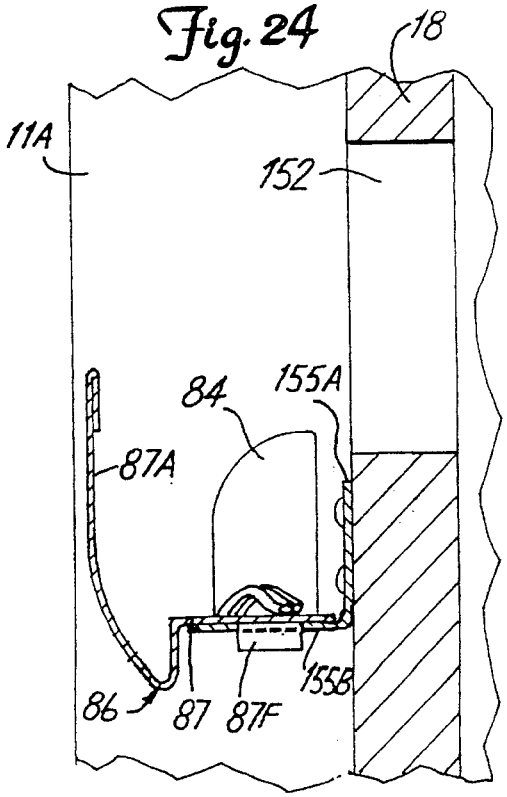

Fig. 25
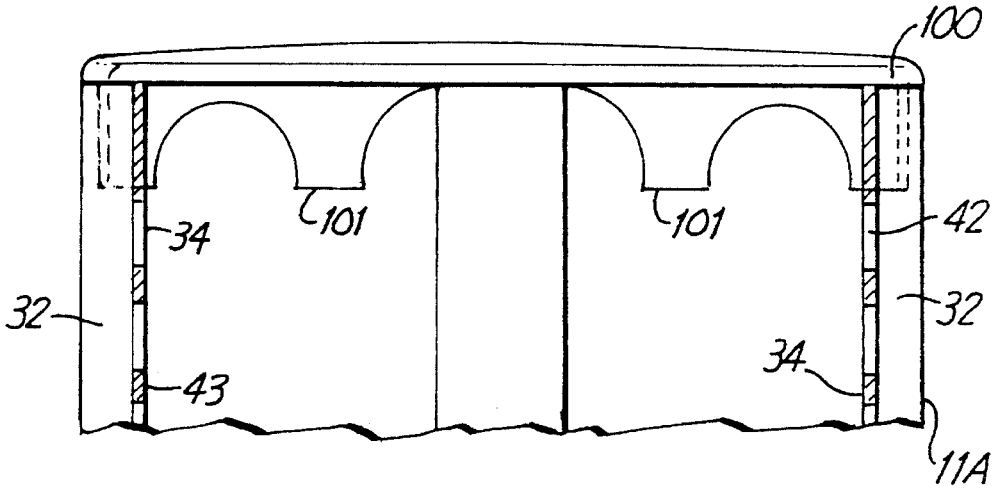
Fig. 26
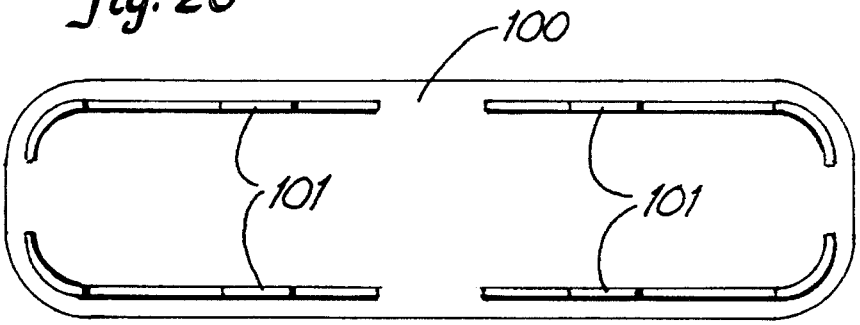
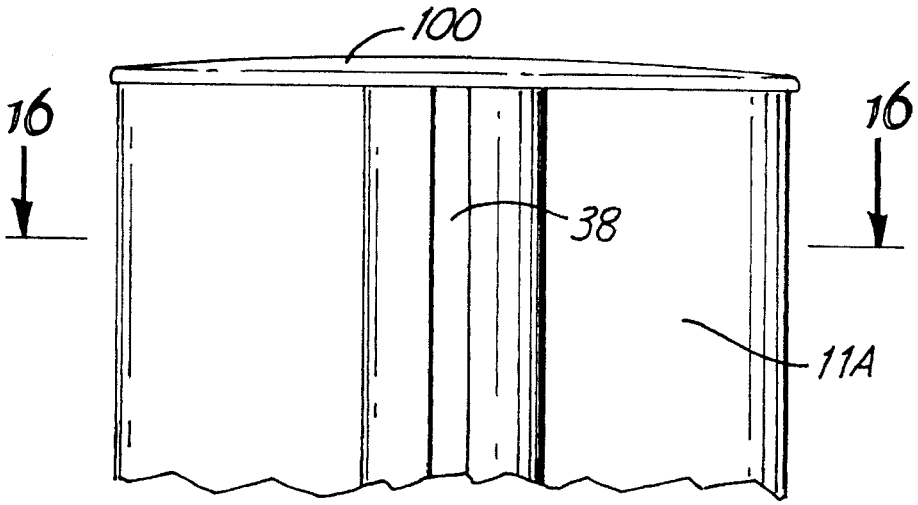
Fig 27

ADJUSTABLE DESK SYSTEM

BACKGROUND OF THE INVENTION

The present invention relates to an adjustable desk system which permits great freedom in arranging side by side and back to back desks, and permits the operating space to be used in a wide variety of configurations.

Various work space management systems and desk systems that provide for adjustability and movability have been advanced.

A number of such systems utilize various adjustable post and component support arrangements, such as that shown in U.S. Pat. No. 5,038,539, and the references cited therein. It is generally desirable to have adjustability of work space desk tops and cabinets and the like for adjusting the components to suit individual users, and also it is desirable to have supports and raceways for electrical conduits and cords for running various office components.

SUMMARY OF THE INVENTION

The present invention relates to an adjustable desk system which utilizes a superstructure upright as a basic component, and cantilevered supports that are mounted to the superstructure upright and which are adjustable for supporting desk tops and other work surface components. The superstructures permit supportive desk tops side by side, and mounted at adjacent ends onto a common upright by a unique arrangement of adjustable interfitting elements such as hooks and slots, with, in the preferred embodiment, the slots being on the upright, and hooks being mounted on cantilevered supports and made so that the hooks of one cantilever support can be positioned in the same slot as that of an adjacent cantilever support. This permits the adjacent end of the work surfaces to be very close together or contiguous, essentially, and yet permits adjustment of height for the individual components.

The superstructures have means for supporting divider (modesty) panels that extend between and are supported on pairs of spaced superstructures, and further the superstructures comprise supports that permit back to back mounting of cabinets, desk tops and the like using a common divider panel between the back to back work place components.

Additionally, in a preferred embodiment, a pedestal or foot that forms a support for the superstructure upright is also mounted in the provided slots utilizing a hook arrangement that will lock the pedestal support in position in engagement with the floor or other supporting surface, but yet permits removal of such support where it would interfere with the feet of a user of the desk system and when it is not needed for actual support because of a configuration that stabilizes the assembly.

The superstructure has side grooves which are usable for supporting cabinets, screens and modesty panels. Four panel intersections can also be formed utilizing a main superstructure and laterally extending end or nose pieces that will in turn support additional cantilevered support members at right angles to the cantilevers on the ends of main superstructure uprights.

The arrangement provides an easily erected, compact and very efficient desk system for use in office environments.

BRIEF DESCRIPTION OF THE DRAWINGS

FIG. 5 is a side sectional view, fragmentarily showing the engagement of the hook and slot supports used with the desk system of the present invention;

FIG. 6 is a perspective view showing a lock for the hook and slot supports used with the desk top supports for the desk system of FIG. 1;

FIG. 7 is a sectional view of the supports shown for the pedestal of FIG. 5 and taken as on line 7—7 in FIG. 5;

FIG. 22 is a front view of a modesty panel showing a cord trough in place along one of the superstructure uprights and schematically illustrating the series of support slots in the dovetailed recesses of the end portions of the end portions of the superstructure uprights;

FIG. 23 is a sectional view taken as on line 23—23 in FIG. 22;

FIG. 24 is a sectional view taken on line 24—24 in FIG. 22;

FIG. 25 is a vertical sectional view of the upper end of a superstructure showing a decorative cap in place;

FIG. 26 is a bottom view of the cap of FIG. 25; and

FIG. 27 is a side elevational view of an upper portion of an upright superstructure showing the laterally opening attachment slot.

DETAILED DESCRIPTION OF THE PREFERRED EMBODIMENTS

Figure 1:
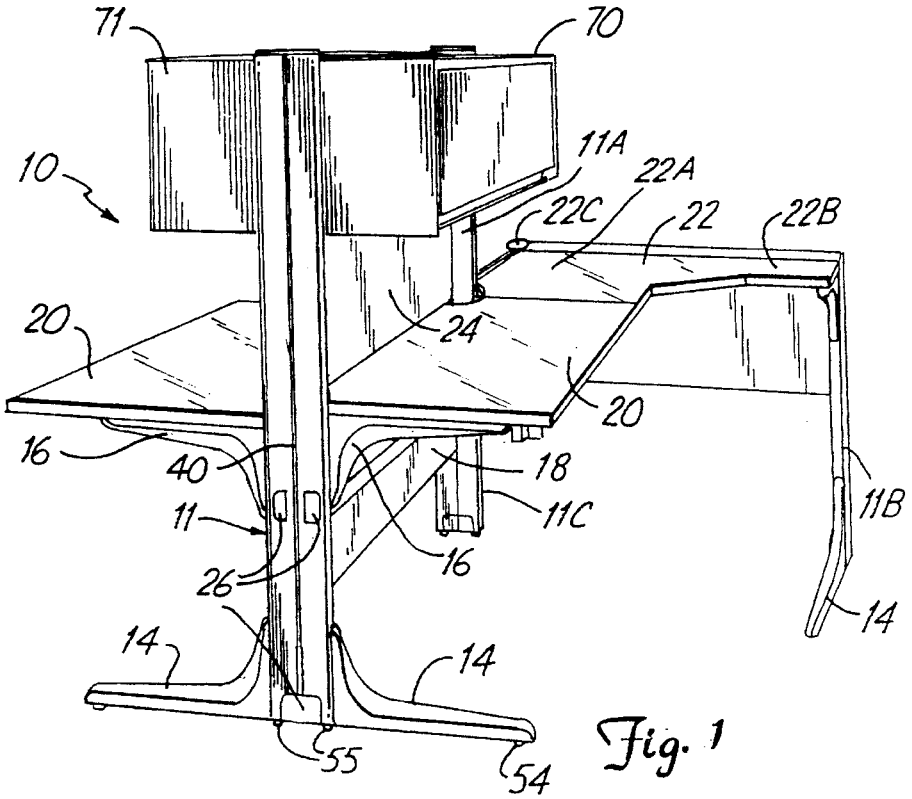
FIG. 1 is a perspective view of a desk system made according to the present invention.
Figure 2:
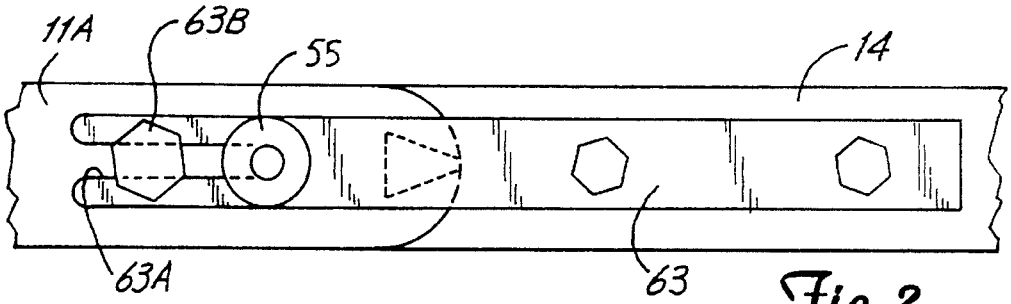
FIG. 2 is a fragmentary bottom plan view of a support for the system of FIG. 1.

Referring to FIG. 1, a desk system 10, made according to the present invention, uses as a basic building component, superstructure upright 11, which is a general number and includes long superstructure uprights 11A and shorter uprights 11B. The height of the superstructure upright can be adjusted for the particular use. However, different lengths are identical in cross sections.

The basic components further include removable cantilever foot pedestal support members 14, that will be attached to suitable superstructure uprights for stability, as will be explained, and adjustable and removable cantilevered desk top supports 16, which mount as will be explained, in the same manner as the foot pedestal supports 14, but inverted.

Additional components include modesty panels 18, between a pair of uprights and suitable desk tops 20, and a corner desk top unit 22 that extends laterally, if desired. Screens 24 can be provided above the work top surfaces 20. The screens can be acoustical panels, marker boards, tack boards, screens having channels or receptacles for holding desk organizers, paper holders or the like.

The upright superstructures 11 include access openings 26 used for electrical cords and connections, at various locations.

Figure 16:
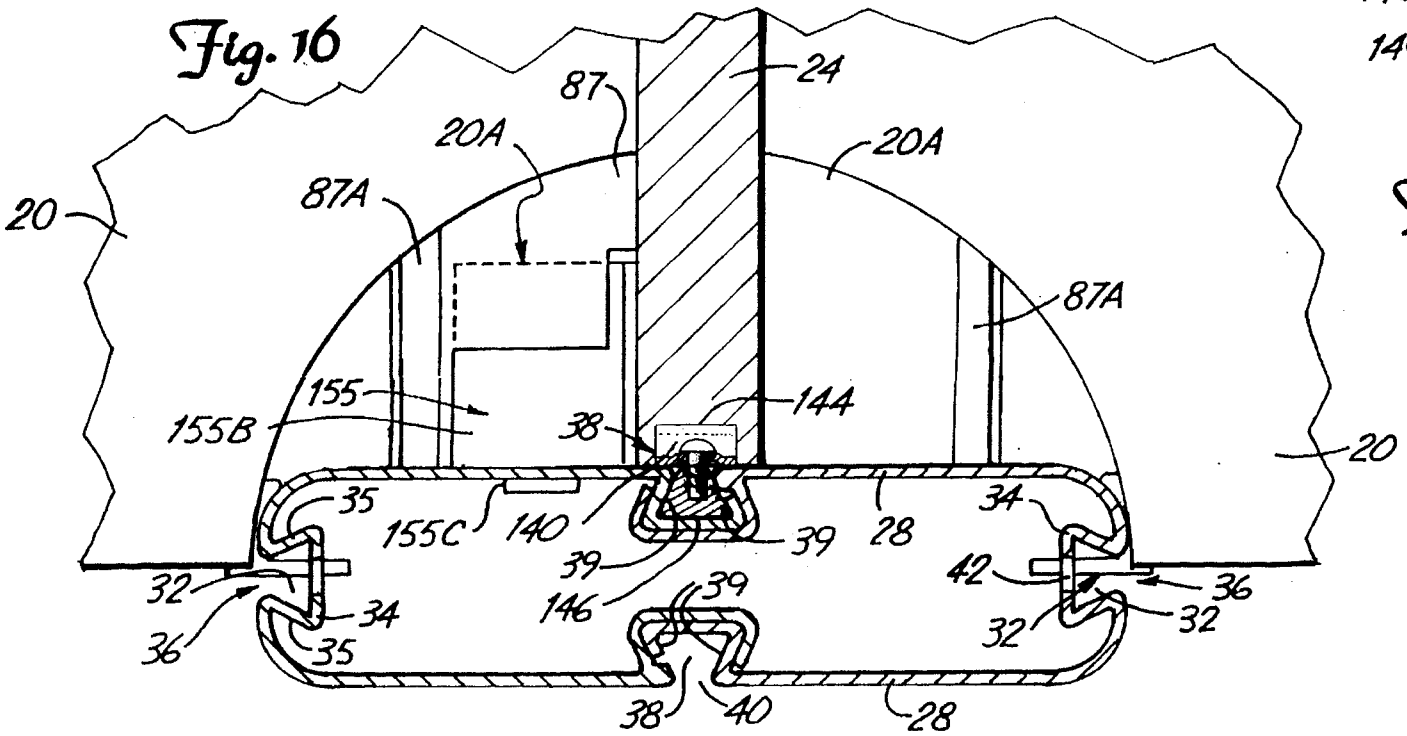
FIG. 16 is a sectional view taken on line 16—16 in FIG. 1 and in FIG. 27.
Figure 19:
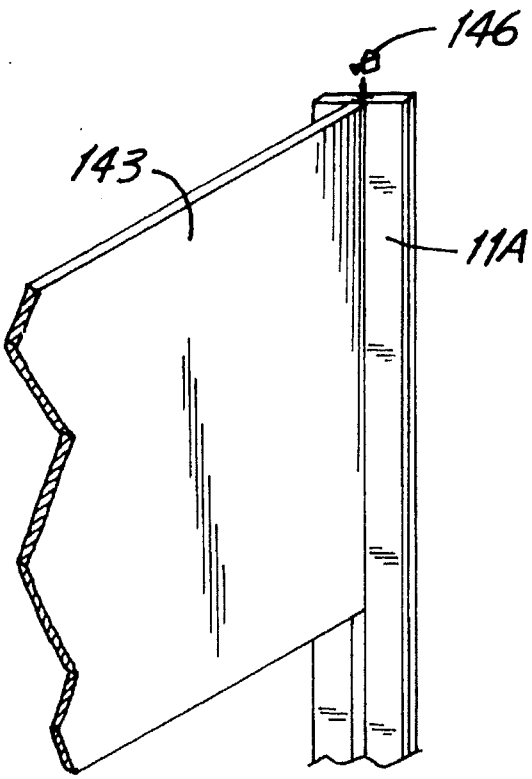
FIG. 19 is a schematic perspective view of the screen of FIG. 18 in a further stage of installation.

Referring to FIG. 16 for an orientation view, the cross sectional shape of the superstructure upright 11A, which is typical of the other superstructures 11, is shown. It can be seen that the superstructure upright has side walls 28 that have surfaces which are oppositely facing, and the superstructure is elongated in a central plane parallel to the side surfaces. The superstructure upright has rounded end portions 30, 30. The end portions have formed dovetailed recesses 32 formed therein. The dovetailed recesses 32 have a back wall 34 and tapered side walls 35, which have interior surfaces that taper inwardly toward a narrower elongated opening 36.

The side walls 28 of the superstructure uprights also have dovetail slots shown at 38 therein, which are used for interlocking or joining two formed sections together for forming the superstructure uprights. There are double walls at the back of these dovetail slots, as shown, but the dovetail side walls have tapered surfaces 39, which taper together toward an elongated opening 40.

The back walls of the dovetailed recesses 32 on the ends of the superstructure uprights have a series of vertically spaced aligned slots 42 formed therein, which leave cross members 43 that form support portions for supporting the cantilever members 16, 16A, as will be explained, or 14, respectively.

Also, as shown in FIGS. 4–7, each of the cantilever supports 16 for the desk top system, has a bracket 44 along a base edge thereof, and this bracket 44 has a tang 45 that extends into and is anchored to the respective cantilever support 16. The tang is centered on the plane of the cantilevered supports. Thus the bracket 44 forms an end piece for the cantilever support, and includes a hook plate 46 that extends outwardly from the end of the cantilever support and has a series of hooks 49 aligned thereon, as shown in FIG. 5. The hooks each have a recess that will receive an edge portion of the cross piece 43 between two of the slots 42 on the back wall 34 of the dovetail recess.

The series of the hooks 49 insure that there will be an adequate support and stability for the cantilever support and the components it holds.

As can be seen in FIGS. 5 and 6, the cantilever supports 16, and as will be explained, similar cantilever supports used for supporting shelves, will be locked in place when they are inserted to have the hooks supported in their respective slots.

As can be seen in FIG. 5, and 6, immediately below the bracket 44, there is a slide lock member 47 that is offset in the manner of the hook brackets, as shown, and has a base tang portion 47A that has a slot 47B therein. The tang slides in a groove 48 formed in the end wall of the cantilever. The slot 47B in the tang 47A receives a cross pin 47C which extends inwardly from one side of the cantilever support 16 across slot 48 so that the slide lock bracket 47 is locked in place in groove 48 but can slide up and down. The tang member 47A also has an aperture 47D.

The lock bracket 47 can thus slide vertically along the base end of the cantilever the amount permitted by the slot 47B and the pin 47C. This amount of movement is selected to permit a locking action with the slide lock member 47. A tab 49A is of size to fit within one of the slots 42 when the tab 48 is in its dotted line position shown in FIG. 5 and in this position the hooks 49 can be raised enough for clearance of the cross bars 43 to enter the slots 42, when the tab is also in a slot 42. When the cantilever is moved downwardly so that the hooks 49 are supported on the cross bars 43, the tab 49A will be moved to its solid line position. At that point, a spring loaded pin 48A that is mounted onto a leaf spring 48B on the exterior of the cantilever 16, and which slides in and out in opening in the cantilever 16 sidewall will be aligned with the aperture 47D and the spring load will snap the pin 48A into place and hold the bracket 47 and thus the tab 49A in the solid line position. The flat spring 48B has sufficient strength so that it will retain the pin in place, and since the tab 49A at that time cannot be moved to its dotted line position until the pin 48A is removed from the opening or aperture 47D, the cantilever 16 will be locked in place with the hooks 49 held over the cross bars 43. The flat spring 48B can be moved to release the pin, and as shown this can be done by pressing on a tab 48C that will permit the pin 48 to be deflected outwardly far enough to clear the aperture 47D. The spring 48B has a shank section 48D that is attached to the sidewall of the cantilever member 16.

Thus, the hook and slot arrangement can be locked in place in the slots and the cantilevers 16 cannot be released until the manual movement of the spring 48B is achieved.

This locking arrangement can be modified by eliminating the spring and actually putting a pin through manually into the aperture 48, or using some other type of lock for holding the tab 49A in a location which will prevent the lifting or movement of the hooks 49 up far enough in the slots 42 to clear the cross bars 43 and be released.

Figure 4:
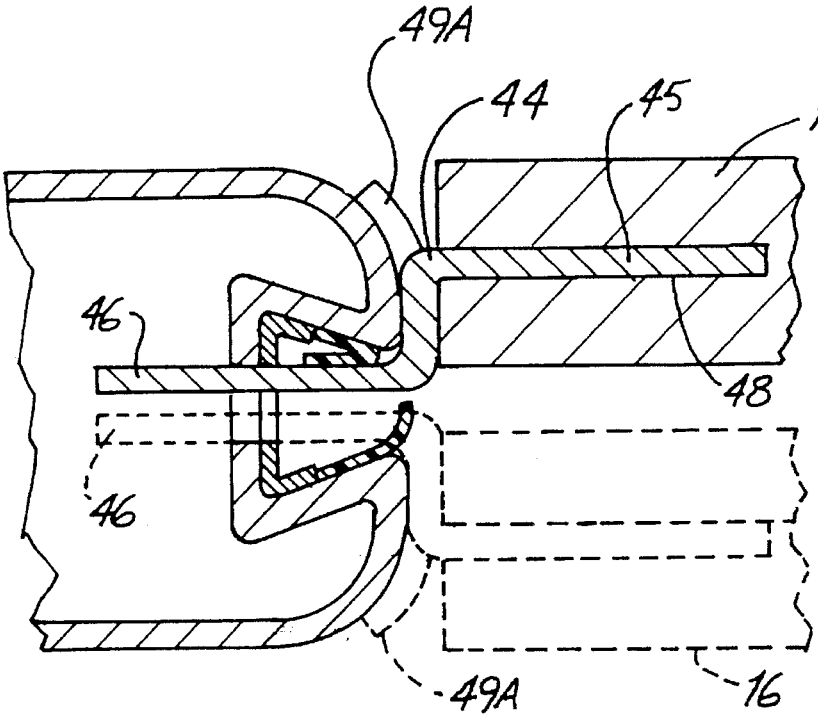
FIG. 4 is a view similar to FIG. 3 showing a pair of supports for desk tops in place.

In addition, each of the brackets 44 have curved tabs 49B, which have a slightly different radius than the outer surface indicated at 30A of the end of the upright so that the facing curved surfaces have a slight interference that tends to cam the hook plate 46 over toward one side of the slots 42, as shown in FIG. 4, so that there is an assurance that the slots 42 will have adequate space for holding a second bracket 44, indicated at dotted lines in FIG. 4, for an adjacent cantilever support, so that side by side cantilever supports will be supported in one or more of the same slots 42. This is shown in FIG. 7.

This will permit the cantilever supports that are mounted on the same end of an upright to be adjusted to different levels without interfering with the supports of an adjacent desk top or other item supported on the cantilever supports. The desk top ends are closely adjacent, but slightly spaced. The slots 42 are substantially twice (plus a slight clearance) as wide as the hook plates 46.

The pedestal cantilever supports 14 are constructed in a similar manner, except, as shown, they have a curved end base surface 50 that matches the curvature of the surface 30A, and hooks 52 for these supports are made to be double width to fill the slots. In other words, the vertically adjacent hooks 52 are offset from each other on a separate tang support 53 mounted on the base of the cantilever support as shown in FIG. 7.

The hooks 52 span a width that is just slightly less than the total width of the slots 42, so that they will be held securely in position by the support force of the ground surface. The pedestal cantilever supports can have suitable adjustable feet indicated at 54 in FIG. 1 so that the loads can be equalized adequately. The uprights also can have adjustable feet indicated at 55, for stability. The hooks 52 have throats that support the cantilever on the cross members 43. The supported weight keeps the hooks engaged in the interlocking slots, and a lock bar 63 can be attached to the bottom of cantilever 14 with cap screws and in turn can be attached to the bottom of the respective superstructure upright 11A. A slot 63A is formed in bar 63 and the bar slides under the head of a cap screw 63B which fits in the slot and which is threaded into the base of the upright for retaining the cantilever in place as shown in FIG. 1A. The lock bar slides above the adjustable foot 55.

Figure 10:
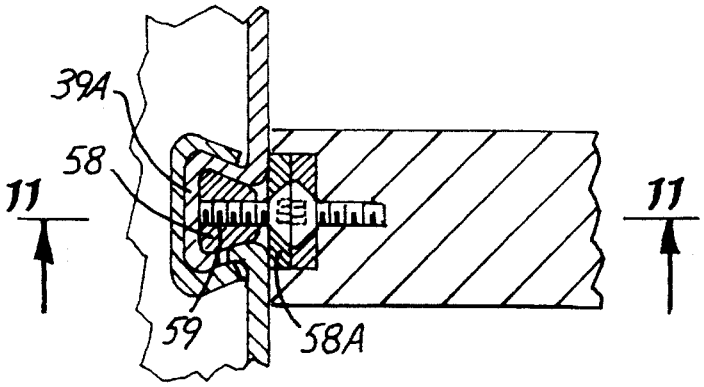
FIG. 10 is a fragmentary sectional view showing a modesty panel or screen attached to a superstructure and taken on line 10—10 in FIG. 11.
Figure 11:
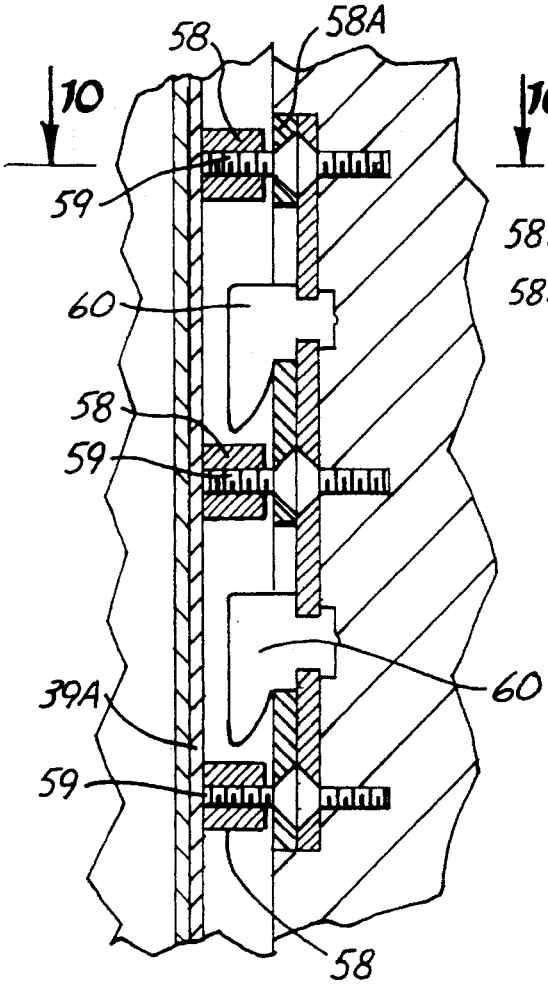
FIG. 11 is a sectional view taken as on line 11—11 in FIG. 10.
Figures 12, 13:
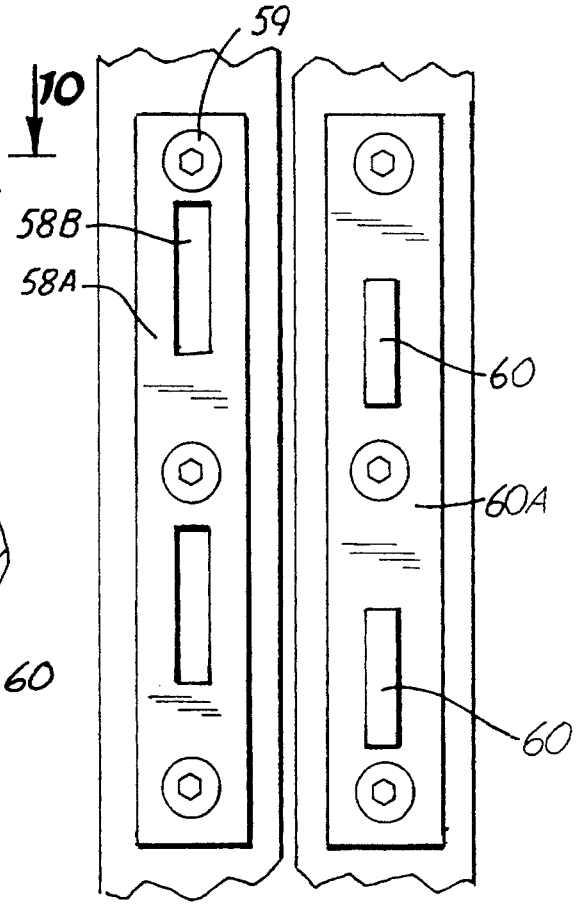
FIG. 12 is a front view of a slot plate held in the superstructure upright of FIG. 11.
FIG. 13 is a front view of a hook plate used in FIG. 11.

The assembly for a desk top system includes two superstructure uprights 11A that are spaced apart, as shown in FIG. 1, and a cross panel can be a desk top 20 supported on respective cantilever supports 16, and suitably fastened in place (this fastening is not shown and can be selected as desired) but also "modesty" panels or vertical panels can be mounted to extend from the side wall of one superstructure upright to the side of another. The dovetail recesses 38 on the side walls are used for securing adapters or holders in place, and as shown in FIGS. 10 and FIG. 11, this can be accomplished by utilizing one or more dovetail shaped slides 58 that can be adjusted upwardly and downwardly along the dovetail slot and held in place by using a set screw 59 that will abut against the inside or end wall 39A of the dovetail recess to force the surfaces of the slide 58 against the surfaces 39 for a secure locking action. Other methods of securing the dovetail slides can be used. For example, the slides 58 can also be fastened by threading a set screw through a threaded opening in the rear wall 39A of the slot. An adaptor plate 58A is supported on set screws 59 and thus on the dovetail slides 58 and has slots 58B therein. The plate 58A is on the outside of the wall 28 of the superstructure upright 11A. The modesty panel 18 has a plate 60A with mating hooks 60 shown in FIGS. 11 and 13,and two such hook plates 60A,one near the top and one near the bottom of the modesty panel 18 can be used for holding the panel in place. This will permit the modesty panel to be hooked in place, after the dovetail blocks holding the slotted plates 58 are locked at a desired position. The position of the modesty panel normally is known so the plates 58 can be locked in place before the panels are put into place.

The hooks 60 can be tapered if desired so that the modesty panel will be tightened against the side surface of the superstructure upright as it slides downwardly for securing the modesty panel tightly.

Figure 14:
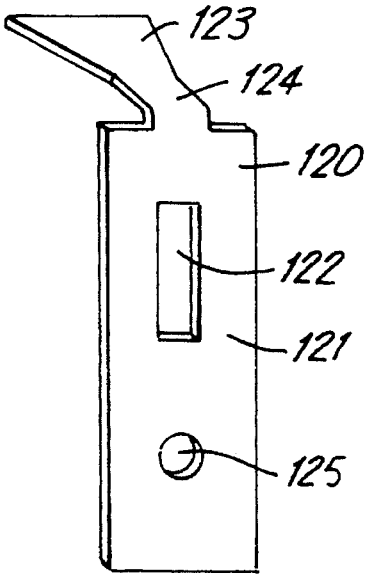
FIG. 14 is a perspective view of a retainer used in dovetail slots.
Figure 8:
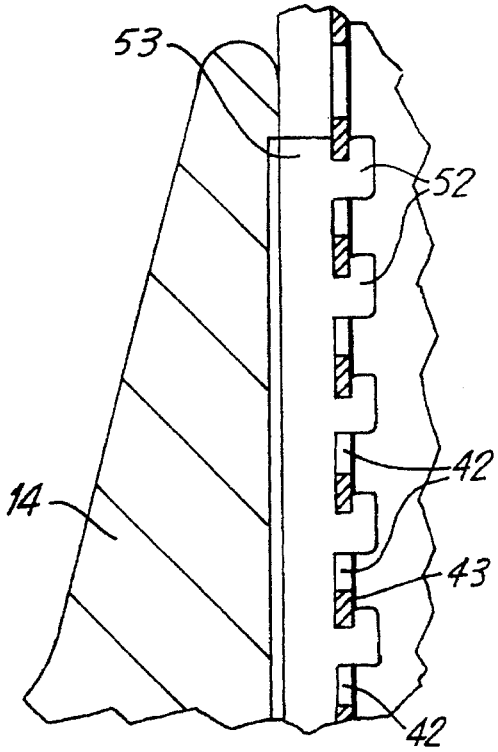
FIG. 8 is a side sectional view, fragmentarily showing the engagement of the hook and slot supports used with the pedestal supports of the present invention.
Figure 9:
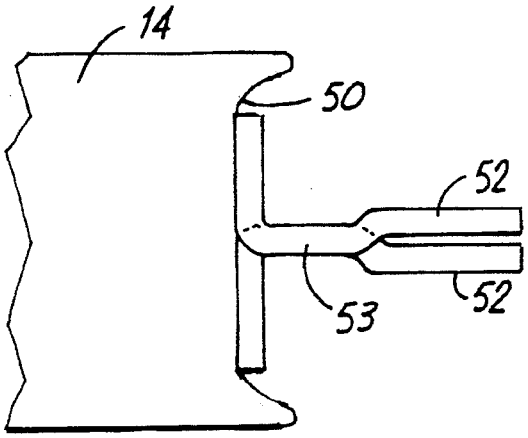
FIG. 9 is a top plan view of the support of FIG. 8.

The use of the dovetail slots permits simplified bracket assemblies to be utilized for holding various members in the dovetail slots. As shown in FIG. 14, a simplified and lower cost bracket 120 is illustrated. This bracket can be stamped out flat and formed out of metal, and has a plate section 121 that includes a slot 122, that will receive the hooks 60 attached to modesty panels, or similar structures that are to be supported. A tab 123 is made to fit the dovetail slot, as shown, and has a neck 124 that will pass through the opening to the dovetail slot.

The tab 123 unit can be merely slipped into the dovetail slot and the plate 121 will be resting against the outer surface of the superstructure upright, either along the sidewalls, or the end if desired. Then all that needs to be done is to thread a screw into the back wall of the dovetail, such as wall 42, by passing the screw through an aperture 125 in plate section 121 and then threading it to lock it tightly against the outer surface of the superstructure upright.

It can be seen that this type of a bracket can be utilized in many different places, and as will be shown, T-nuts or weld nuts can be utilized in the dovetail slots and receive threaded screws for clamping various adapters or brackets in place. This arrangement can also be used for mounting other components, including vision screens that would fit between the surfaces of back to back units shown in FIG. 1 and flipper cabinets or shelves. The hooks could be offset so these are two rows of hooks and one set would hold one cabinet while the second would hold a second cabinet back to back as shown in FIG. 1.

Figure 15:
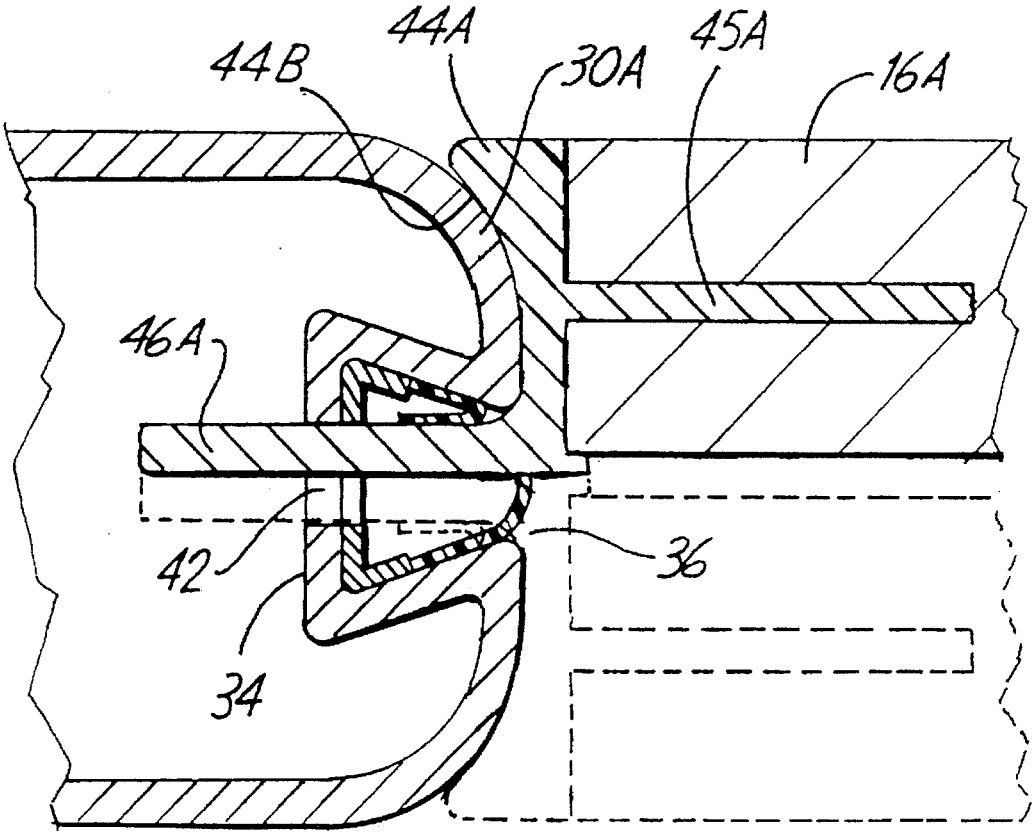
FIG. 15 is a sectional view similar to FIG. 4 showing shelf supports.

The superstructure uprights have the vertically aligned slots 42 formed along the entire length of the dovetail recesses in the ends of the uprights, and these slots are used for supporting adapter members for holding shelves, upper flipper top cabinets, or other accessory cabinets between the superstructure uprights above the desk top surfaces. The cantilever supports 16A for shelves and cabinets are made essentially the same as the cantilever supports 16. The cross section of the end of the supports 16A are as shown in FIG. 15. The upper section of the superstructure 11A is shown in fragmentary cross section, and has a rounded surface 30A as previously pointed out. The cantilever supports 16A for the shelves or cabinets are made so that they fit more closely together than the supports for the desk top when they are side by side in the position shown in FIG. 15. The cantilever supports 16A have a recess for receiving a tang 45A of a bracket 44A that includes a hook plate 46A that extends through the opening 36 of the end of a superstructure upright and through the slots 42 formed in the base wall 34 of the dovetail. The bracket 44A is cast to have a rounded interior surface that has an end portion 44B on the exterior that will tend to hold or cam the hook plate 46A of the bracket over toward one side of the slot 42 in the superstructure upright. The shelves or cabinets can then be supported on top of the cantilever supports 16A and they extend between the pair of superstructure uprights 11A above the desk tops.

The cantilever supports 16A fasten into the slots 42 with the base wall 34 of the dovetail in the same manner as previously explained and the hooks can be locked in place using a slide lock similar to tab 49A. Generally speaking, however, the spring pin 48A will be replaced with a screw holding the lock tab in locked position. The screw could also be used for attaching the shelf to the bracket, and would merely pass through the locking bracket to hold it in place.

As shown in FIG. 1, the modesty panel 18 will extend between two desk tops 20 that are back to back. Two flip top cabinets or shelf units indicated at 70 and 71 can be mounted back to back in the area between the superstructure uprights 11A using the cantilevers 16A.

The cabinets 70 and 71 are conventional units that may have flip up doom, or could be open shelves. The cabinets 70 and 71 fit between the superstructure uprights and extend over the desk tops.

The use of the dovetail slots and the dovetail slide permits vertical adjustment of screens, marker boards including the conversion back for door cabinets, which greatly enhances the versatility of the unit.

In FIG. 16, it is shown that the comer portions of the desk tops 20 can be cut away as at 20A to provide clearance for the superstructures, and to insure that there will be no interference in fit so that the cantilever supports 16 will positively locate the desk tops 20 and to provide openings for wire management for transferring wires from above the work surface to below.

As can be seen in FIG. 16, the superstructure uprights 11A have dovetail slots along the sidewalls 28 are provided with various adapters for holding modesty panels and the like. Referring to FIGS. 16–19, when a screen partition 24 is being put into place, or if other items are to be supported between the uprights, a way of attaching the screen 24 or a panel between the uprights 11A is illustrated in these Figures.

Figure 17:
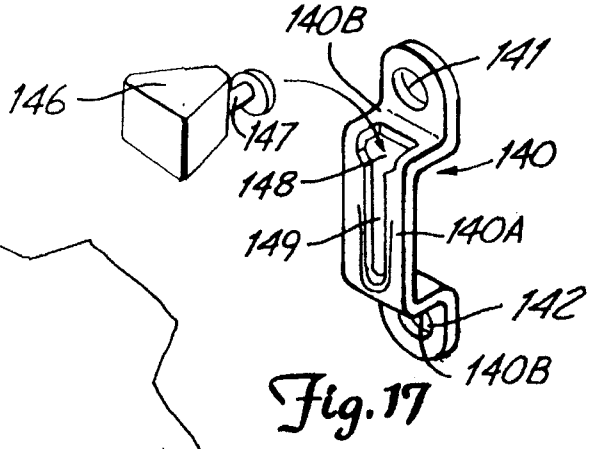
FIG. 17 is a schematic perspective view of a bracket used for attaching screens to the uprights of the present invention.

A typical bracket is shown in FIG. 17, and illustrated at 140. This bracket 140 has an offset center strap 140A supported on end legs 140B which have end tabs thereon. The end tabs have attaching holes 141 and 142. The bracket can be placed into a recess in the end of screen 24. The recess is shown in FIG. 16, at 144. The bracket 140 is shown in section. Recess 144 permits the strap 140A of bracket 140 to be essentially flush with the outer edge of the screen 24 so the edge is held right along the wall 28 of a superstructure upright 11A.

Figure 18:
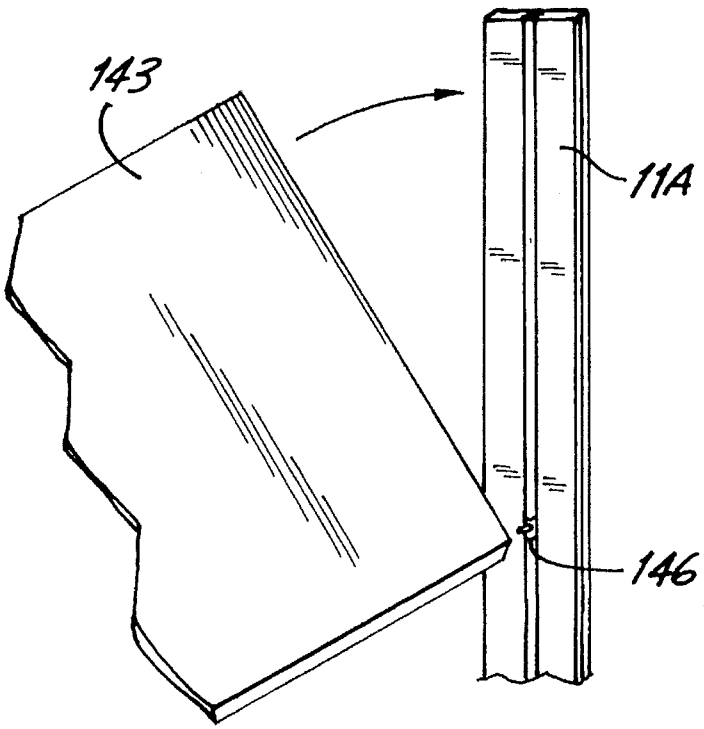
FIG. 18 is a schematic perspective view of installation of a screen on superstructure uprights.

A dovetail block 146 can be slid into the dovetail slot and held in place with a suitable screw, or some other means of holding it at a desired level. Block 146 has a headed pin 147 (see FIG. 17) protruding out through the slot opening from the dovetail slot on the wall 28. This headed pin 147 is of size so that it will enter a top aperture 148 in one end leg 140B leading to a slot 149 in the center strap 140A of bracket 140, and the head on the pin 147 will lock the bracket 140 in place on the pins. Once the pin is slid down into this slot, the head of the pin will hold it in place. A screen panel 143 as shown in FIG. 18 has a bracket 140 that is inverted from the position shown in FIG. 17, and is held in place on upright 11A as shown at 145 in FIG. 18. This block 146 in the dovetail slot has the headed pin protruding out from the sidewall 28 of the upright 11A, and when the bracket is slipped in place the pin will be in the slot 149 and held so that the panel 143 can be rotated upwardly on the pin 147 held on the lower block 145. When the panel is in place, another one of the blocks 146 can be slipped down through the top of the dovetail groove, as shown schematically at 146 in FIG. 19 and when this is done the block 146 will drop into place along the slot. The bracket will be oriented as shown in FIG. 17 so that the head will drop through the opening 148 and be trapped in the slot 149 of the upper bracket 140 to hold the screen panel securely. If desired a type of tightening mechanism can be made for the upper block 146 either by way of an angled in screw threaded into the top of the block, or by way of a wedge or some other means.

Again in this instance, in some places there will be an extrusion used on the edges of the screens or panels. The extrusions would have walls formed similar to that shown in the extrusion 88. The same type of block can be utilized with a headed pin 147 for holding extrusions in place, instead of having the edges of the screen routed out with a groove.

Figure 20:
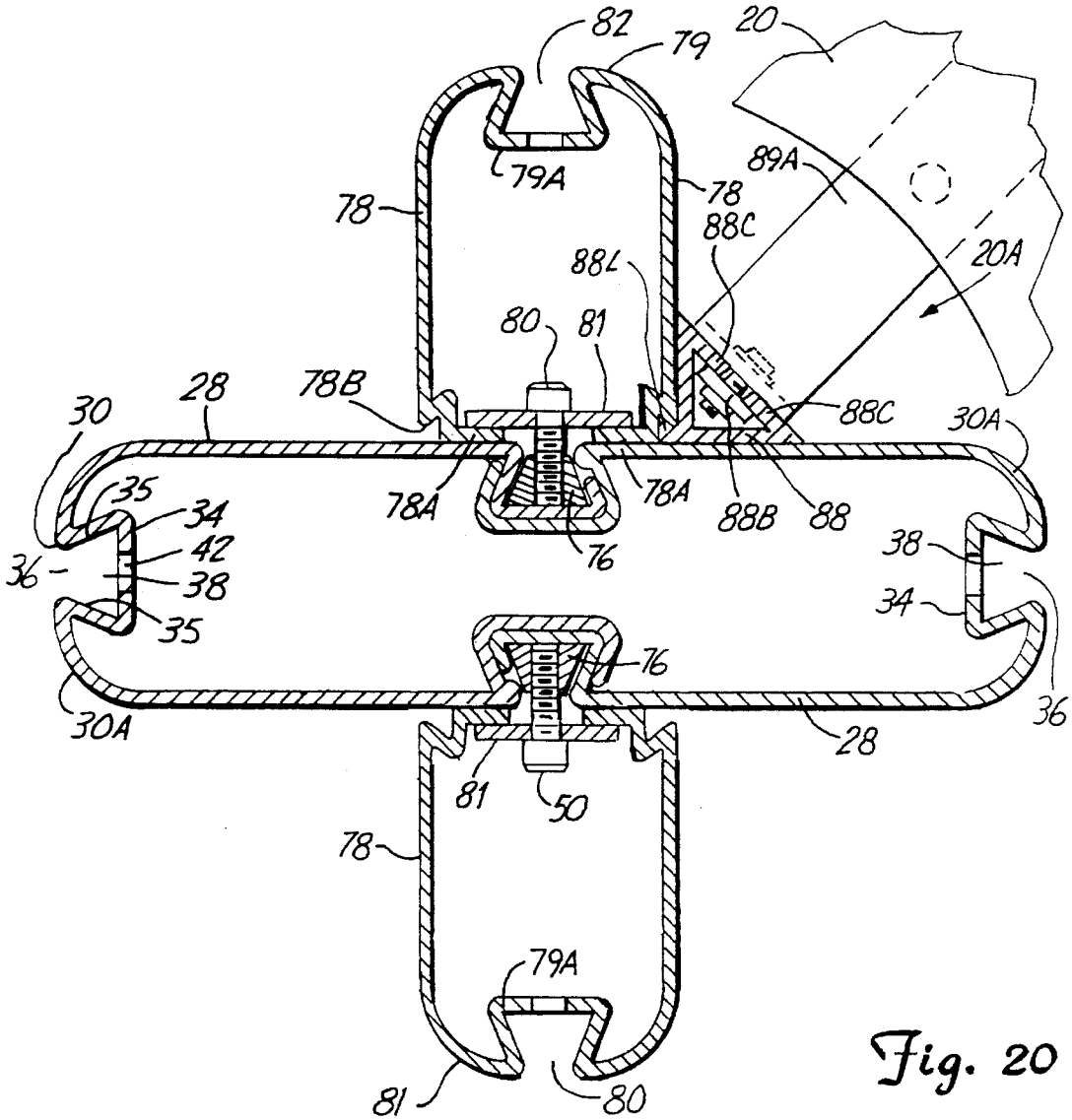
FIG. 20 is a sectional view showing a "cross" or intersecting arrangement for the superstructure to permit desk tops and panels to be extending in two mutually perpendicular directions.

As shown in FIG. 20, when a set of desk tops extending from an intersecting superstructure upright are to be used, the superstructure upright 11 can be modified so that it will provide for extensions of modesty panels or divider walls in planes at right angles to the main superstructure longitudinal axis in opposite directions from the side panels. As shown, the dovetail slots or guides on the side walls receive dovetail slides such as that shown at 76, which are substantially similar to those shown at 58, and these slides can be adjusted to the desired height and be of a desired length and number. A superstructure upright adaptor 78 that is formed to have an outer curved surface indicated at 79 that is identical to the outer end 30 of the main superstructure upright and which are formed into a channel are held in place utilizing inwardly turned ends 78A along the longitudinal sides. A fiat strap bracket 81 in turn can slide along the adaptor and can be tightened in place utilizing a set screw 80 bearing against the rear wall of dovetail slots to clamp the dovetail slide 76 tightly against the surfaces of the dovetail slot and hold the unit securely in place. The clamp set screw 80 can be adjusted through the end wall 79A of the adaptor 78, inserting suitable tools through apertures in the wall, or through the existing slots that are there.

Supports can be placed into the dovetail slots shown at 82 in the end portion 79 of the superstructure upright adaptor 78 in a conventional manner.

The adapters 78 have grooves 78B at their comers adjacent the wall 28 and an extrusion 88 has an interfitting lip 88L that locks under the lip of grooves 78B to lock the extrusion 88 in place.

Figure 21:
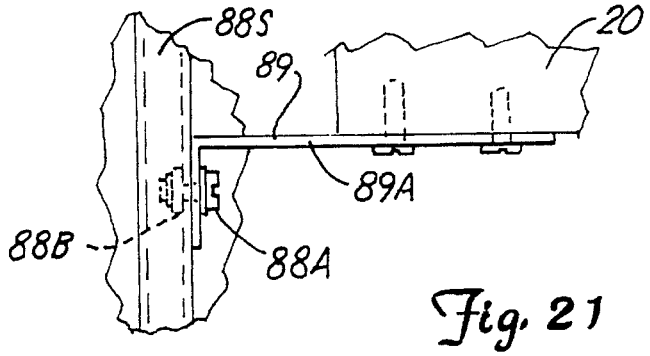
FIG. 21 is a side view of a desk top support shown in FIG. 20.

The extruded section which is shown at 88, forms a general V shaped opening with walls 88C extending inward from the V walls to define slot or aperture 88A therein. A nut, such as a T-nut indicated at 88B, can be slid into the opening behind the walls defining the opening, and a screw is threaded into nut 88B and is used for holding a bracket 89 in position as shown in FIG. 21. The bracket 89 has a bent leg through which the screw passes, and a main strap portion 89A extends across or spans the opening 20A in the corner of the desk top 20 which passes underneath the desk top to provide support for the desk top. Suitable screws can be used for fastening the strap portion 89A to the underside of the desk top. This same type of,slide bracket or extrusion 88 thus is used in the arrangement where there are crossing members such as that shown in FIG. 20.

This arrangement of the interlocking lips on the extrusion and the end portion 79 holds the extrusion 88 securely in place and permits the addition of the support bracket 89. The bracket 89 is easily made and installed.

As can be also seen in FIGS. 16 and 20, the superstructures are hollow, and provide passageways for running electrical conduit, telephone lines and the like through the openings 26 that are covered with removable cover plates. When a conduit or cord is run through the superstructure, it can be exited from the superstructure on the interior side of the superstructure upright through suitable openings shown at 84 in FIG. 24. A modesty panel 18 is shown in place, and a trough 86 is mounted adjacent to modesty panel, so that a lower wall 87 of the trough is supported on the modesty panel, and upright wall 87A forms an open topped trough that permits one to run electrical wires, telephone wires or the like and keep them up off the floor and out of the way. The troughs will hold loose extension cords and telephone extension cords as well, As shown in FIGS. 22, 23 and 24, the back wall electrical trough 86 includes a flange 151 which fits into an elongated opening 152 formed in the modesty panel 18, for supporting the trough on the modesty panel. The flange 151 and a portion of the back wall 153 are terminated adjacent the respective uprights 11A, in order to provide for mounting onto a mounting bracket 155. The mounting bracket 155 has a back flange 155A that is supported with screws to the modular panel 18, as shown in FIG. 22. This flange 155A of bracket 155 has a horizontal portion which is shown at 155B. The horizontal panel 155B has a bent down tab 155C that fits over the bottom of the opening 84 in the upright sidewall 28. (see also FIG. 16)

The tab supports the bracket 155 and the horizontal wall 155B of the bracket adequately. The rear wall 87B of the trough is cut away or trimmed near the bracket 155. The rear wall 87B is shown in FIG. 22, and the trimmed part is shown at 87C. The horizontal wall 87 of the trough 86 then can be supported on the horizontal wall 155B of the bracket 155. The bottom wall 87 of the trough has a small tab 87F that is bent down and the tab fits into a slot or opening in the bottom wall 155B of the bracket 155.

This then supports the trough adequately, and if desired a suitable set screw can be put into position in the bottom wall of the trough and into the horizontal wall of the bracket to hold it securely in place.

The opening 152 in panel 18 can be used for mounting suitable electrical outlets, such as that represented schematically at 160.

This permits adequate wiring to be run up through the hollow walls of the uprights, through the openings 84 and into the troughs on the opposite sides of the modesty panel 18.

The panels can thus easily be provided electrical power, and one of the advantages of the present desk system is that the cantilever pedestals can be removed from superstructure uprights that are positioned such that the cantilever pedestals would interfere with foot movement of the user of the desk system. As illustrated in FIG. 1, when there is a corner desk top panel 22A and an integral laterally extending panel section 22B which form an "L" shape desk top unit 22. The interior corner 22C would be supported by a superstructure upright that would be without a pedestal support, if desired, or would have a pedestal extending parallel to one of the edges along the rear of the desk top unit 22. The second superstructure upright from the left end 11C would have its cantilever support pedestal removed, and the pedestal would not be protruding into the foot space of the user of the desk corner unit. The desk corner unit 22 would be adequately supported by the outer edge upright support and cantilever pedestal moving the "L" shape, but the convenience of not bumping ones feet against the pedestal from one of the uprights is greatly appreciated by the user.

In many units where there are pedestals supporting the uprights, they are welded in place and can not be removed if they are in the way of movement of the user's feet.

Although a particular method of attaching the modesty panels is shown, other ways of attaching them to the side dovetail slots can also be utilized. Key hole slots will work in many instances, as will other types of interfitting, interlocking and removable members.

The present desk base system permits additional options such as the flipper door cabinet units, the side by side desks with the adjacent desk tops adjustable to different heights, and supported in common support slots that are occupied by the support hooks of both cantilever supports.

Figure 3:
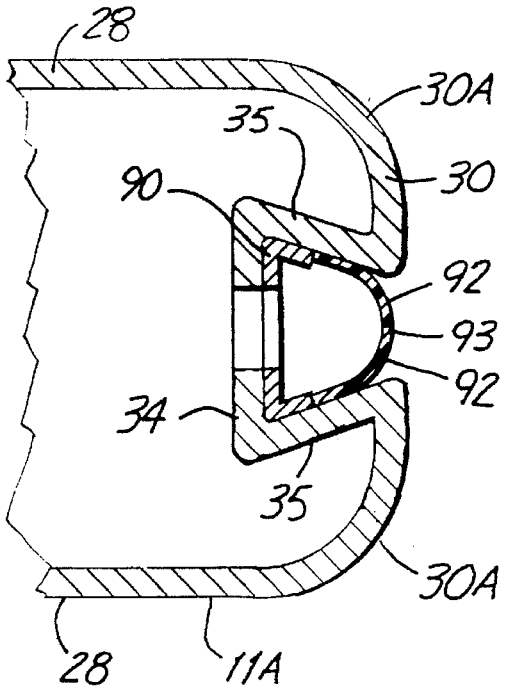
FIG. 3 is an enlarged fragmentary sectional view of one edge of a superstructure upright shown in FIG. 1.

In FIG. 3, it also can be seen that the end 30 of the uprights, and the dovetail slots can be provided with a resilient seal that enhances the appearance of the slots when not covered. The seal assembly indicated at 90 includes a base channel 91 that slides into the dovetail slot, and carries a pair of current resilient separated vinyl strips 92, 92 which meet in the middle along a parting line 93, These vinyl strips then will fold back when the cantilever supports are put in as shown in FIG. 4, but when the cantilever supports are removed, the vinyl strips will again spring outwardly and will essentially close the dovetail slot opening and will hide the support slots from view during use.

Top caps are utilized on the upright supports as shown in FIGS. 25, 26 and 27. There, the top cap 100 is a molded cap curved in the suitable manner for the top, having skirt portions 101 that slip within the openings of the tops of the superstructure uprights, and providing a gap as shown at 102 for the dovetail slots that are formed into the side walls of the unit.

Likewise, when the intersecting upright members are formed, as shown in FIG. 20, a cap is supported in the openings at the top of the superstructure uprights.

The flipper cabinets and shelves are adjustable to fit the needs of the user, and individual user needs as to height can be accommodated.

Although the present invention has been described with reference to preferred embodiments, workers skilled in the art will recognize that changes may be made in form and detail without departing from the spirit and scope of the invention.

What is claimed is:

1. An adjustable desk system comprising:

a superstructure upright having a generally vertically disposed spaced series of first elements of removable mating pairs of interlocking elements along one edge thereof;

a cantilever support having a series of second elements of the removable mating pairs of interlocking elements along a base edge, the second elements being spaced to match the spacing of the vertically disposed series of first elements, said elements interlocking to support the cantilever support on the superstructure upright;

the edge of the superstructure upright having a rounded exterior surface formed in cross section around a longitudinally extending axis of the superstructure upright; and the cantilever support having a curved surface engaging the rounded exterior surface of the superstructure upright when in place and supported by the interlocking elements, the curved surface of the cantilever support formed to generally conform to at least a portion of the rounded exterior surface of the superstructure upright to urge the second elements to one lateral side of the mating elements on the superstructure upright.

2. The adjustable desk system of claim 1 wherein one of the first and second elements comprise slots and the other of the interlocking elements comprise interfitting hooks.

3. The adjustable desk system of claim 2 wherein the hooks are on the cantilever support and the slots are on the edge of the superstructure upright, and the hooks on the cantilever support are formed to have one side surface substantially coplanar with one side surface of the cantilever support.

4. The adjustable desk system of claim 3 wherein the slots on the superstructure upright are slightly wider than the hooks, and a second cantilever support formed as a mirror image of the first mentioned cantilever support, the second cantilever support having a set of hooks that are interfitted with the slots of the superstructure upright on the same edge as the first cantilever support, the second cantilever support being along one side of the first mentioned cantilever support, and the hooks of the first and second cantilever supports fitting within at least some of the same slots.

5. The adjustable desk system of claim 1 and a cantilever foot support, said foot support having a base and a support edge, the base having hooks formed to have upwardly facing receptacles, the hooks interfitting in a plurality of slots of the superstructure upright adjacent a bottom of the superstructure such that the support edge engages a support surface to support the superstructure upright.

6. The adjustable desk system of claim 1 and a second superstructure upright spaced from the first superstructure upright and having a cantilever support attached thereon, the cantilever supports having upwardly facing support edges, and a desk top attached to the cantilever supports on the upwardly facing support edges and extending therebetween, wherein the cantilever supports are disposed on each corresponding superstructure upright to provide a level upwardly facing support surface.

7. The adjustable desk system of claim 6 wherein the spaced first and second superstructure uprights have dovetail cross section slots formed on the facing side surfaces thereof, a slide lock bracket mounted in each dovetail slot and movable relative to the superstructure uprights, and a panel supported on the slide lock brackets and extending between the superstructure uprights, the panel .having a plane positioned substantially parallel to the longitudinally extending axes of the superstructure uprights.

8. The adjustable desk system of claim 7 and means to support the panel on the superstructure uprights comprising interlocking hooks and pins on the panel and superstructure uprights.

9. The adjustable desk system of claim 8 wherein the superstructure uprights have oppositely facing edges with first elements thereon and cantilever supports having second elements supported on each of the edges of each superstructure upright and extending in opposite directions from the superstructure uprights, and a pair of back to back desk top panels mounted on the aligning cantilever supports such that desk tops extend in opposite directions from the superstructure uprights.

10. The adjustable desk system of claim 8 and a trough supported to at least one side of the panel and of size to hold electrical cords, the trough extending to position adjacent to the superstructure uprights, and a brace extending between the ends of the trough and the respective superstructure uprights to aid in locking the panel onto the superstructure uprights.

11. The adjustable desk system of claim 10 and a opening in the panel at a level aligned with the trough, the opening having an electrical outlet therein.

12. The adjustable desk system of claim 11 wherein the superstructure uprights are formed with internal passageways, and access openings in the sides of the uprights for permitting access to the passageways for electrical wiring.

13. The adjustable desk system of claim 12 wherein at least one of the access openings opens adjacent to the trough for permitting electrical cords to pass from the passageway in a superstructure upright to the trough.

14. The adjustable desk system of claim 1 wherein the curved surface of the cantilever support has a radius of curvature different than the corresponding portion of the rounded exterior surface of the superstructure upright.

15. An adjustable desk system comprising:

a superstructure upright having a pair of spaced sidewalls and a pair of opposite edges joining the sidewalls, each of the edges having a plurality of generally vertically disposed, spaced support slots for receiving and supporting hooks;

a cantilever support having a plurality of hooks along a base edge, the hooks being spaced to match the spacing of the vertically disposed support slots, said hooks being removably interfitting with said support slots to support the cantilever support on the superstructure upright at selected vertical heights at the opposite edges of the superstructure upright;

the edges of the superstructure upright each having a rounded exterior surface formed in cross section about a longitudinally extending axis of the superstructure upright, the rounded surfaces each having a continuous access slot through which the hooks extend to engage the vertically spaced support slots;

the sidewalls of the superstructure upright each having a substantially continuous slot extending vertically along the superstructure upright-and opening to the outer surfaces of the respective sidewall, the continuous slot in the sidewalls having slot walls defining a cross section forming a wider width on an interior end of the continuous sidewall slot than the continuous slot opening in the respective sidewalls to form clamping surfaces on an interior of the continuous sidewall slot;

a lock mounted in the continuous sidewall slot in at least one sidewall and movably positioned along the length of the superstructure upright; and a clamp member to clamp the lock against the clamping surface of the at least one continuous sidewall slot of the superstructure upright for supporting a desk component relative to the at least one sidewall of the superstructure upright.

16. The adjustable desk system of claim 15 and the cantilever support comprising a cantilever foot support, said cantilever foot support having a base and a support edge, the base having the plurality of hooks opening upwardly for removably interlocking with the support slots, to carry vertically upwardly directed loads to the associated superstructure upright when the support edge of the foot support engages a support surface.

17. The adjustable desk system of claim 16 wherein there are three superstructure uprights arranged to form an L shape and having desk top panels supported on the uprights such that one upright is aligned with locations occupied at least part of the time by feet of a user of the desk top panels, the cantilever foot support for the one superstructure upright being removed and the other superstructure uprights having cantilever foot supports mounted thereon for stabilizing the uprights.

18. The adjustable desk system of claim 16 and a cantilever desk top support having a plurality of second aligned hooks along a base edgeland spaced to match the spacing of the vertically disposed slots for mounting on a respective superstructure upright, said second hooks interlocking with the slots to support the cantilever desk top support on the superstructure upright, the slots for the cantilever desk top support being in vertical alignment and the same size as the slots for the cantilever foot support.

19. The adjustable desk system of claim 18 wherein the second hooks on the cantilever desk top support are substantially one-half the width of the vertically disposed slots so the second hooks of one cantilever desk top support fit into the same slots as the second hooks of a second cantilever desk top support, and wherein the edge of the each upright has a rounded exterior surface formed in cross section around a longitudinally extending axis of the upright, and each cantilever desk top support has a curved surface on its base edge engaging the curved outer surface of the superstructure upright when in place and supported in the slots, the curved surface of the cantilever desk top support formed to urge the hooks on the respective desk top support to one lateral side of the slots engaged by the second hooks of such cantilever desk top support.

20. An adjustable desk system comprising:

a superstructure main upright having upright edges including edge portions formed for supporting desk components and sidewalls between the edges and having an adapter section with a clamping cross section slot formed therein and opening to the surface of at least one sidewall of the main upright and extending along a length of the main upright;

a clamp slide mounted in the slot and being positioned along the length of the main upright;

a clamp member to clamp the clamp slide relative to the main upright;

a bracket carried by the clamp slide for supporting a desk component relative to the main upright; and the bracket carried by the adapter section of the at least one sidewall comprising an adapter upright having a cross section replicating the cross section of an end portion of the main upright, the adapter upright extending laterally outwardly from the at least one sidewall to form an upright desk component support member having at least one adapter upright with a substantially identical edge portion to the edge portions of the main upright portions for supporting desk components.

21. The adjustable desk system of claim 20 wherein a dovetail adapter section of the superstructure upright is provided in each sidewall, and the brackets carried by the dovetail adapter sections having cross sections replicating the cross section of an end portion of the superstructure upright to form a cross shaped member having four substantially identical end portions, and supports formed on the end portions for supporting desk components.

22. An adjustable desk system comprising a pair of spaced superstructure uprights, each having oppositely facing ends and parallel side surfaces, the spaced uprights having side surfaces which face each other;

a desk top support bracket mounted on each end of each superstructure upright to form a pair of support brackets extending in opposite directions from a central plane extending between the superstructure uprights;

a separate desk top supported on each pair of brackets and having back edges adjacent each other adjacent and extending between the uprights;

the desk tops extending in opposite directions from the central plane;

the spaced superstructure uprights having upright elongated slots formed on the facing side surfaces thereof, with clamping surfaces defining the slots, a slide lock bracket mounted in each slot and movable along the respective slot relative to the superstructure uprights and being lockable in a selected position; and a panel supported on the slide lock brackets and extending between the superstructure uprights, the panel having a plane positioned substantially parallel to the longitudinally extending axes of the superstructure uprights.

23. The adjustable desk system of claim 22 wherein the slots in the facing side surfaces of the spaced uprights have dovetail cross sections, and brackets slidably lockably mounted in the dovetail slots for supporting desk system members between the uprights.

24. The adjustable desk top system of claim 22 wherein each pair of brackets is adjustable independently of the other pair of brackets.

25. The adjustable desk top system of claim 24 and a pair of separate desk accessory members supported in the upright elongated slots relative to the side surfaces of the superstructure uprights, extending between the superstructure uprights and overlying portions of the desk tops, the accessory members being positioned back to back adjacent the central plane and extending in opposite directions from the central plane.

26. The adjustable desk top system of claim 25 wherein the accessory member comprises a cabinet.

27. An adjustable desk system comprising:

a superstructure upright comprising a pair of upright sections, each section having first and second sidewalls and an edge wall between the sidewalls, and having a plurality of generally vertically disposed, spaced support slots extending along the edge for receiving mating hooks to support a desk component;

the first sidewall of each upright section having a first sidewall slot formed therein and opening outwardly, and defined by interior surfaces that have portions that narrow an outwardly facing opening to the slot at a location spaced outwardly from a base of the slot;

the second sidewall of each upright section having a wall portion formed to interfit within the interior surfaces of the first sidewall slot formed in the first sidewall of the other upright section and defining a second sidewall slot having an outwardly facing opening, the slots of the first and second sidewalls of one upright section each interfitting with the slot of an opposite wall of the first and second walls of the other upright section for joining the upright sections together to form the superstructure upright having the upright section edges facing in opposite directions and having a vertically extending sidewall slot on each sidewall for clamping components therein, and a plurality of vertically disposed support slots at opposite edges of the superstructure upright.

28. The adjustable desk system of claim 27 in which the superstructure upright sections are identical in cross section, the sidewalls having different cross sectional sizes and complementary cross section shape such that walls forming the slot of the second sidewall of each superstructure upright section interfit with slots of the first sidewall of the other superstructure upright section when one of the superstructure upright sections is inverted relative to the other.

29. The adjustable desk system of claim 28, wherein the first and second side wall slots have dovetail cross sections.

* * * * *

UNITED STATES PATENT AND TRADEMARK OFFICE

CERTIFICATE OF CORRECTION

PATENT NO. : 5,544,593

DATED : August 13, 1996

INVENTOR(S) : Canfield et al.

It is certified that error appears in the above-indentified patent and that said Letters Patent is hereby corrected as shown below:

Column 12, line 43, please delete "edgland" and insert --edge and--.

Signed and Sealed this

Eleventh Day of February, 1997

Bruce Lehman

*Attest:*

BRUCE LEHMAN

*Attesting Officer*

*Commissioner of Patents and Trademarks*